US005429235A

United States Patent [19]

Chen

[11] Patent Number: 5,429,235

[45] Date of Patent: Jul. 4, 1995

[54] TOOL BOX ASSEMBLY

[75] Inventor: Chang Chen, Taichung Hsien, Taiwan

[73] Assignee: Tung I Enterprise Co., Ltd., Taiwan

[21] Appl. No.: 323,912

[22] Filed: Oct. 17, 1994

[51] Int. Cl.[6] ..... B65D 85/28

[52] U.S. Cl. ..... 206/373; 206/372; 220/4.27

[58] Field of Search ..... 206/38, 234, 372, 373, 206/541, 546; 220/4.27, 23.4, 23.86

[56] References Cited

U.S. PATENT DOCUMENTS

| | | | |
|---|---|---|---|
| 4,619,363 | 10/1986 | Wolfseder | 206/373 |
| 5,114,007 | 5/1992 | Chen | 206/373 |
| 5,145,064 | 9/1992 | Chen | 206/373 |
| 5,259,502 | 11/1993 | Chen | 206/372 |
| 5,271,501 | 12/1993 | Chen | 206/373 |
| 5,294,196 | 3/1994 | Chen | 312/263 |

FOREIGN PATENT DOCUMENTS

| | | | |
|---|---|---|---|
| 11797 | of 1902 | United Kingdom | 312/218 |

*Primary Examiner*—David T. Fidei
*Attorney, Agent, or Firm*—Baker & Botts

[57] ABSTRACT

A tool box assembly includes a main case having two main casing halves, each of which has top, bottom and two opposite side ends. The main casing halves are hinged together at the bottom ends. Each of the main casing halves has a wall panel which extends between the top, bottom and side ends and which is opposite to the wall panel of the other one of the main casing halves. The wall panel has an inner part, which is formed integrally with an inner containing portion, and an outer part which has an outer face and which is formed integrally with an outer containing portion. Two subcases are respectively and removably received in the outer containing portions of the main casing halves. Each of the subcases has a cover and a housing which is hinged to the cover and which contacts face-to-face the outer face of a respective one of the main casing halves. Interlocking members are used for releasably retaining the subcases in the outer containing portions, and are formed integrally on the wall panels of the main case and the housings of the subcases.

9 Claims, 6 Drawing Sheets

TOOL BOX ASSEMBLY

BACKGROUND OF THE INVENTION

1. Field of the Invention

This invention relates to a tool box assembly, more particularly to an improved tool box assembly which comprises a plurality of cases that can be coupled with one another.

2. Description of the Related Art

Generally, a variety of tools are prepared for satisfying the needs of different conditions. Therefore, a conventional tool box is designed to have a large receiving space for containing the different tools therein. In this way, the user usually carries a heavy load with a lot of unnecessary tools. This is inconvenient and troublesome.

In order to overcome the drawback of the conventional tool box, a tool box assembly is manufactured and includes two casing halves coupled releasably with each other. If desired, the user can take only one casing half rather than carrying the casing halves simultaneously, thereby minimizing his load.

SUMMARY OF THE INVENTION

The objective of this invention is to provide an improved tool box assembly which includes three pieces of cases capable of coupling with one another so as to provide a variety of assembly modes.

The tool box assembly according to this invention includes a main case having a pair of main casing halves each of which has a top end, a bottom end and two opposite side ends between the top and bottom ends. The main casing halves are hinged together at the bottom ends thereof. Each of the main casing halves has a wall panel which extends between the top, bottom and side ends and which is opposite to the wall panel of the other one of the main casing halves. The wall panel has an inner part, which is formed integrally with an inner containing portion, and an outer part which has an outer face and which is formed integrally with an outer containing portion.

The tool box assembly includes two subcases respectively and removably received in the outer containing portions of the wall panels of the main casing halves. Each of the subcases has a cover and a housing which is hinged to the cover and which contacts face-to-face the outer face of the outer part of a respective one of the main casing halves.

The outer containing portion of the wall panel of each of the main casing halves is opened at the top end for removal one of the subcases from the outer containing portion, and is further opened at the outer face of the outer part of the wall panel.

The tool box assembly includes interlocking members for releasably retaining the subcases in the outer containing portions of the wall panels. The interlocking members are formed integrally on the wall panels of the main case and the housings of the subcases.

The interlocking members of the subcases are interengageable for coupling releasably the subcases after the subcases are removed from the outer containing portions, and are engageable respectively with the interlocking members of the wall panels to retain the subcases in the outer containing portions.

The outer containing portion of the wall panel of each of the main casing halves may include a surrounding wall which projects outwardly from and transversely of the outer face of the outer part of the wall panel and which extends along the bottom and side ends of the main casing halves.

Each of the main casing halves has an imaginary axis of symmetry extending from the top end to the bottom end. The housing of each of the subcases has a top and a bottom end, an outer face extending between the top and bottom ends and opposing the outer face of the wall panel of a respective one of the main casing halves, and an imaginary axis of symmetry extending from the top end to the bottom end of the housing. The interlocking members include a mortise joint and a tenon joint formed on the outer face of each of the wall panels and the housings respectively at two symmetrical positions about the imaginary axis of symmetry of a respective one of the main casing halves and the housings and parallel to the imaginary axis of symmetry. The tenon joint coincides with the mortise joint.

BRIEF DESCRIPTION OF THE DRAWINGS

Other features and advantages of the present invention will become apparent in the following detailed description of the preferred embodiments, with reference to the accompanying drawings, in which.

DETAILED DESCRIPTION OF THE PREFERRED EMBODIMENTS

Figure 1:
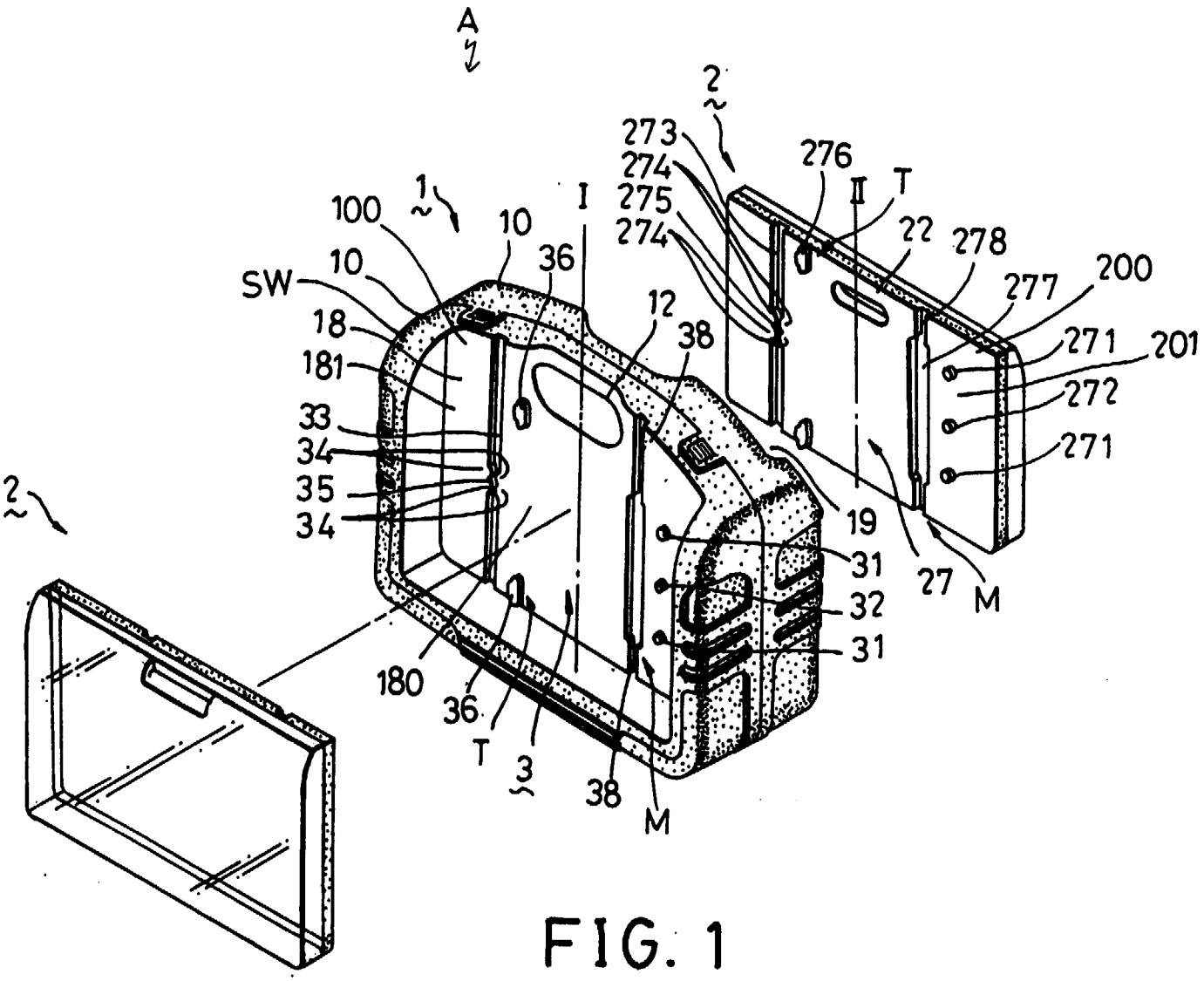
FIG. 1 is an exploded view of a tool box assembly of this invention.
Figure 2:
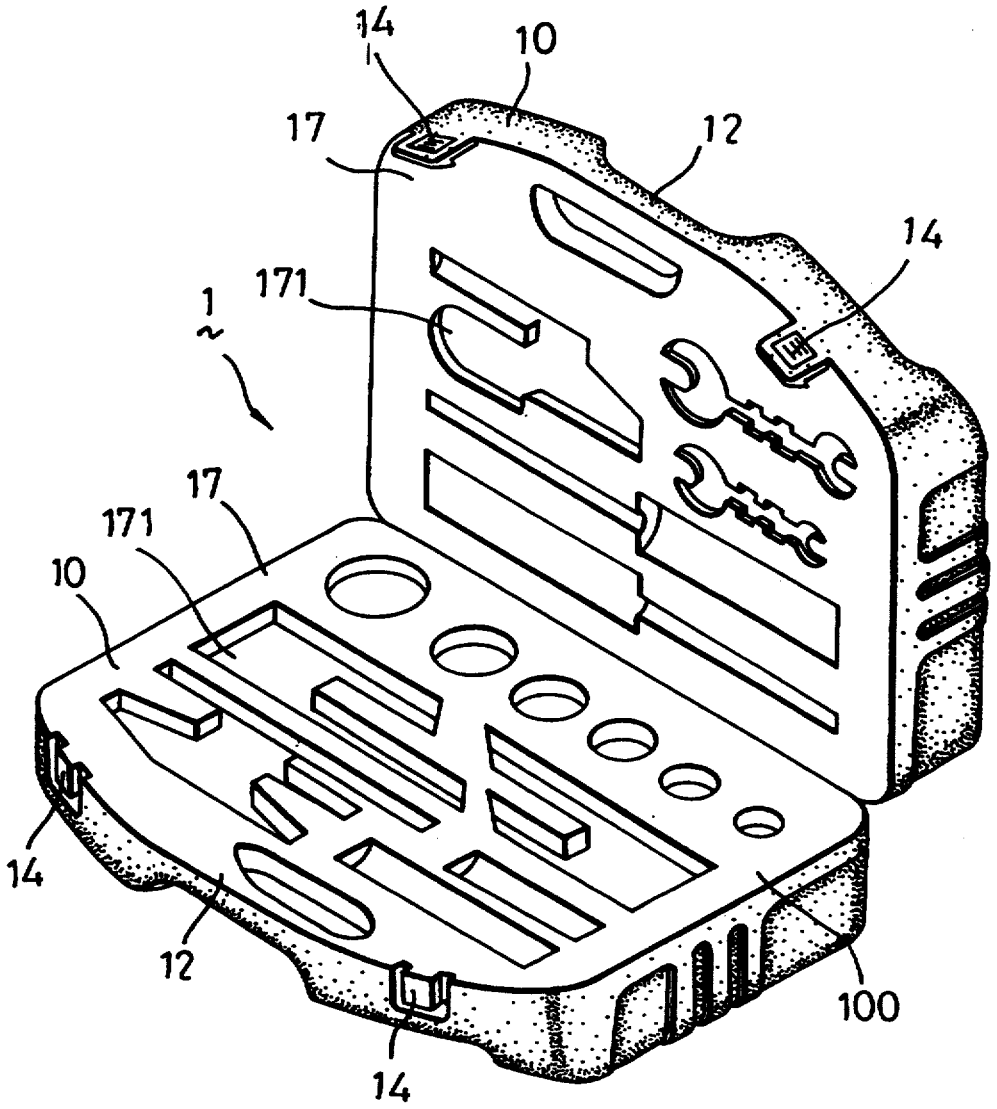
FIG. 2 is a perspective view of a main case of the tool box assembly of this invention when opened.

In the detailed description of the preferred embodiments, it should be noted that like elements are indicated by the same reference numerals throughout the disclosure.

Referring to FIGS. 1 to 4, a tool box assembly (A) according to this invention includes a main case 1 and two identical subcases 2. The main case 1 has a pair of main casing halves 10, each of which has a top end, a bottom end and two opposite side ends between the top and bottom ends. The main casing halves 10 are hinged together at the bottom ends. Each of the main casing halves 10 has a wall panel 100 which extends between the top, bottom and side ends and which is opposite to the wall panel 100 of the other one of the main casing halves 10. The wall panel 100 has an inner part 17, which is formed integrally with inner containing portions 171, and an outer part 18 which has an outer face 180 and which is formed integrally with an outer containing portion 181. The outer containing portion 181 is opened at the top end and is further opened at the outer face 180. The outer containing portion 181 includes a surrounding wall (SW) which projects outwardly from and transversely of the outer face 180 and which extends along the bottom and side ends of the main casing half 10.

Each of the main casing halves 10 has a handle half 12, which is formed on the wall panel 100 adjacent to the top end, and an imaginary axis of symmetry (I)

which extends from the top end to the bottom end and which divides symmetrically the handle half 12. The main case 1 has two pairs of press-fitted fastening members 14 respectively provided at the top ends of the main casing halves 10.

Figure 3:
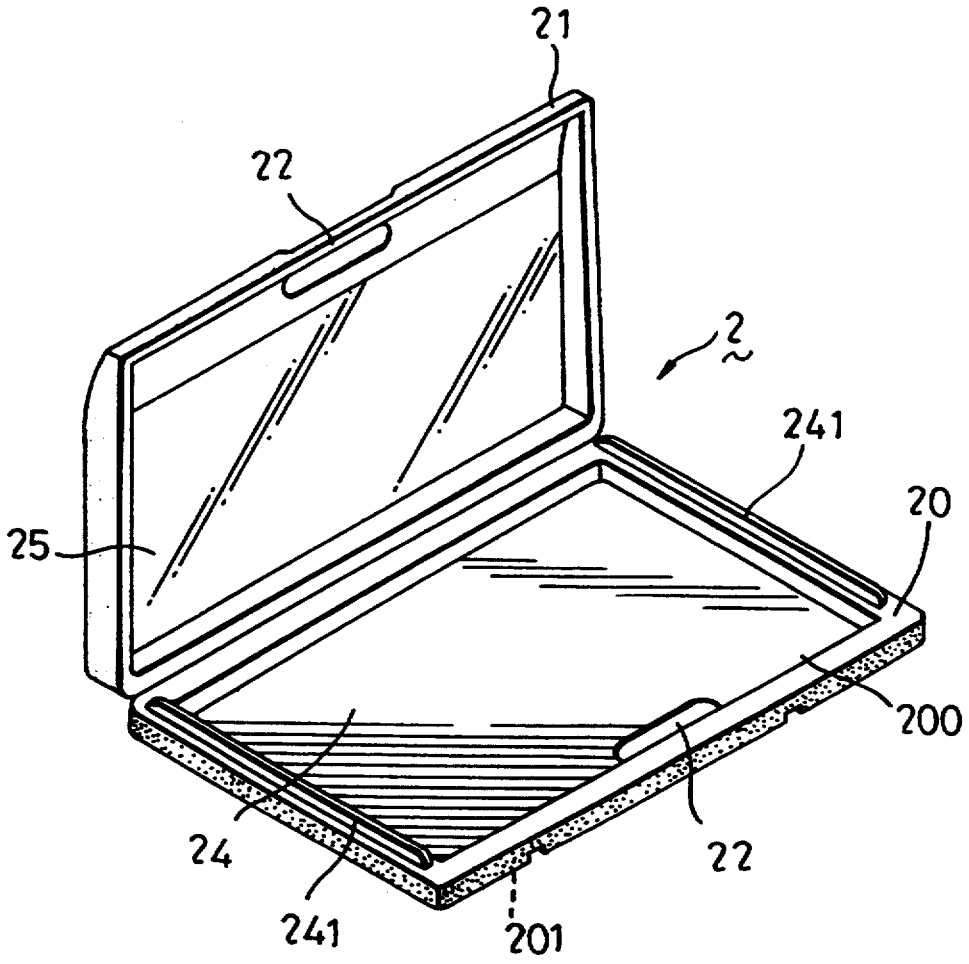
FIG. 3 is a perspective view of a subcase of the tool box assembly of this invention when opened.
Figure 4:
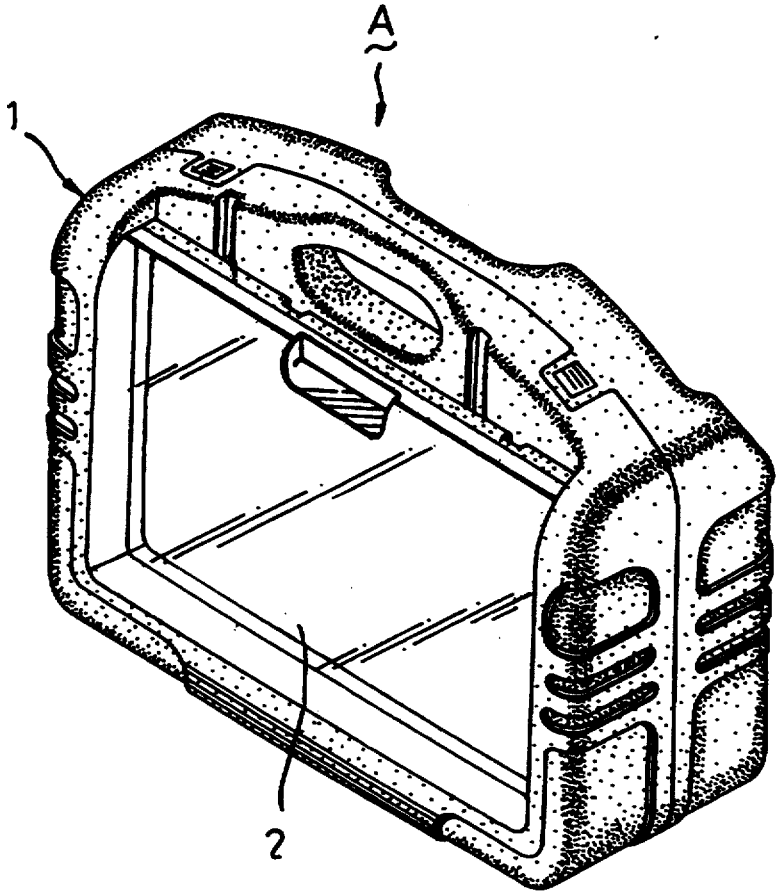
FIG. 4 is an assembled view of the tool box assembly shown in FIG. 1.

Referring to FIGS. 1, 3 and 4, the subcases 2 are respectively and removably received in the outer containing portions 181 of the wall panels 100. Each of the subcases 2 has a cover 21, which is made of a transparent material, and a housing 20 which is hinged to the cover 21 at the bottom end thereof and which contacts face-to-face the outer face 180 of the outer part 18 of a respective one of the main casing halves 10. The cover 21 of the subcase 2 has an inner recessed part 25 and a handle half 22 formed adjacent to the top end of the cover 21. The housing 20 has a base wall 200 with an outer face 201, an inner recessed part 24, two elongated ribs 241 projecting inwardly from the peripheral sides of the base wall 200, and a handle half 22 formed adjacent to the top end of the housing 20. In addition, the housing 20 has an imaginary axis of symmetry (II) extending from the top end to the bottom end and dividing symmetrically the handle half 22.

Referring to FIG. 1, the tool box assembly (A) includes interlocking members 3, 27 for releasably retaining the subcases 2 in the outer containing portions 181 of the wall panels 100. The interlocking members 3, 27 are formed integrally on the outer faces 180 of the outer parts 18 of the wall panels 100 and the outer faces 201 of the base walls 200 of the housings 20. In addition, the interlocking members 27 of the subcases 2 are interengageable with each other for coupling releasably the subcases 2 after the subcases 2 are removed from the outer containing portions 181, and are engageable respectively with the interlocking members 3 of the main casing halves 10 so as to retain the subcases 2 in the outer containing portions 181.

The interlocking member 27 formed on the outer face 201 of the base wall 200 of each of the housings 20 includes a mortise joint (M) and a tenon joint (T) located respectively at two symmetrical positions about the imaginary axis of symmetry (II) and parallel to the imaginary axis of symmetry (II). The tenon joint (T) coincides with the mortise joint (M) such that the tenon joint (T) of one of the subcases 2 can fit tightly in the mortise joint (M) of the other one of the subcases 2 when the subcases 2 are coupled together. The tenon joint (T) includes aligned top and bottom tenon blocks 276. The mortise joint (M) includes an elongated mortise 278 which extends from the top end to the bottom end. The elongated mortise 278 has top and bottom portions, each of which has a width coinciding with that of each tenon block 276, and an intermediate enlarged portion 277 which has a width that is wider than that of the tenon block 276 and which has a length larger than that of the tenon block 276.

The outer face 201 of the base wall 200 of the housing 20 of each of the subcases 2 has a positioning protrusion 272 formed at a right side of the imaginary axis of symmetry (II) and spaced from and outwardly of the elongated mortise 278, and upper and lower guiding protrusions 271 similarly formed at the right side of the imaginary axis of symmetry (II) and aligned with the positioning protrusion 272. The outer face 201 further has a slide groove 273 formed at a left side of the imaginary axis of symmetry (II) and spaced from and outwardly of the tenon blocks 276. The slide groove 273 extends from the top end to the bottom end at a position symmetrical to that of the guiding and positioning protrusions 271, 272 about the imaginary axis of symmetry (II). The slide groove 273 has a width coinciding with the outer diameter of the positioning protrusion 272 in order to permit sliding of the positioning protrusion 272 of another subcase 2 therein, and has two pairs of constricted portions 274 to confine a locking area 275 in the slide groove 273. The locking area 275 coincides with the positioning protrusion 272 and is symmetrical to the positioning protrusion 272 about the imaginary axis of symmetry (II).

Referring to FIG. 1, the interlocking member 3 formed on the outer face 180 of the outer part 18 of each of the main casing halves 10 has a structure similar to that of the interlocking member 27 on the subcase 2. The interlocking member 3 also includes a mortise joint (M) and a tenon joint (T) located respectively at two symmetrical positions about the imaginary axis of symmetry (I) and parallel to the imaginary axis of symmetry (I). The tenon joint (T) includes aligned upper and lower tenon blocks 36. The mortise joint (M) includes an elongated mortise 38 which extends from the top end to the bottom end of the main casing half 10 and which has an intermediate enlarged portion. The outer face 180 is also formed with aligned positioning and guiding protrusions 32, 31 and a sliding groove 33. The sliding groove 33 extends from the top end to the bottom end and has constricted portions 34 confining a locking area 35 in the slide groove 33. Referring to FIGS. 1 and 4, the elements of the interlocking member 3 on the outer face 180 of each of the main casing halves 10 have sizes, shapes and relative positions identical to that of the elements of the interlocking member 27 on the outer face 201 of each of the subcases 2 except that the elongated mortise 38 and the sliding groove 33 have a length larger than that of the elongated mortise 278 and the sliding groove 273 of the interlocking member 27 of the subcase 2.

Figure 5:
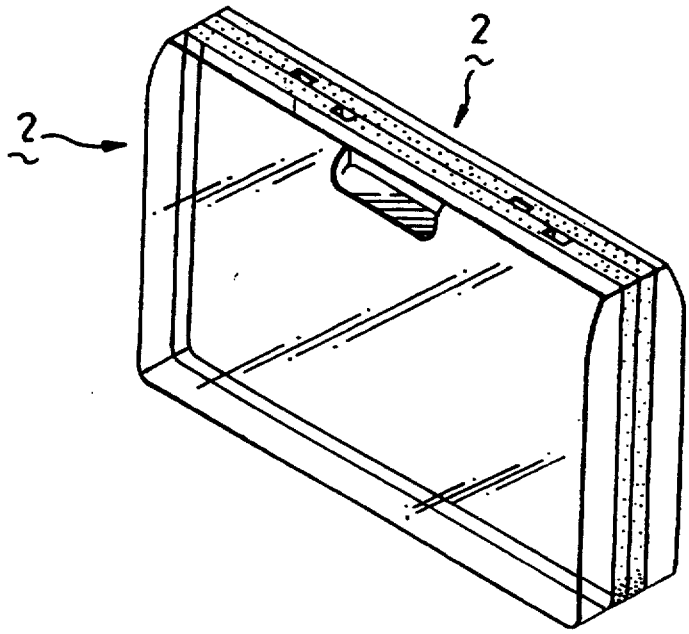
FIG. 5 is an assembled view of two subcases of the tool box assembly shown in FIG. 1.

Referring to FIGS. 4 and 5, with the provision of the interlocking members 3, 27 of the main case 1 and the subcases 2, the subcases 2 can be coupled with the main case 1 and can also be coupled with each other. When assembling the main case 1 and one of the subcases 2, the main case 1 and the subcase 2 are juxtaposed to each other by disposing the outer faces 180, 201 face-to-face. The subcase 2 is operated manually to force the tenon blocks 276 to slide into and fit in the elongated mortise 38 of the main case 1 via the top end of the main casing half 10 so that the tenon blocks 276 engage tightly the top and bottom portions of the elongated mortise 38, and to permit simultaneously the guiding and positioning protrusions 271, 272 to slide into the slide groove 33 of the main case 1 so that the positioning protrusion 272 is retained in the locking area 35 of the main case 1. The two subcases 2 can also be coupled together by means of the above process. Thus, the main case 1 and the subcases 2 can be coupled with one another as desired.

In use, a plurality of subcases 2 can be prepared. Tools are arranged respectively in the main case 1 and the subcases 2 according to their functions. The user may carry, as desired, one of the main case 1 and the subcases 2, or the combination of any two subcases 2. Furthermore, the combination of the main case 1 and at least one subcase 2 can be used. By the use of the tool box assembly (A) of this invention, the user can carry the required tools by means of different assembly modes without carrying an additional load of unnecessary tools.

Figure 6:
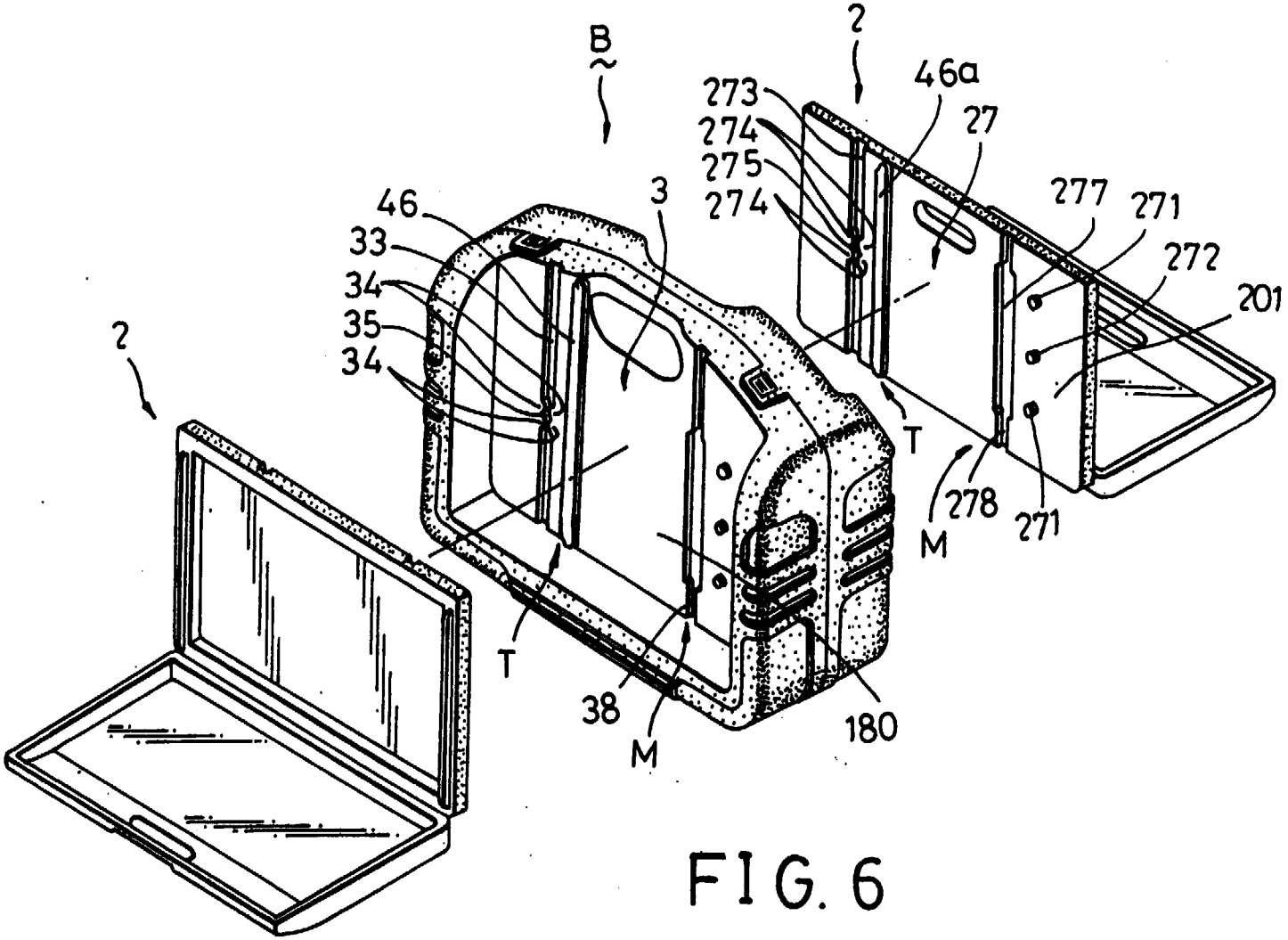
FIG. 6 is an exploded view of another preferred embodiment of the tool box assembly of this invention.

FIG. 6 shows another preferred embodiment of the tool box assembly (B) of this invention. The tool box assembly (B) also includes the main case 1 and two identical subcases 2. The structures of the main case 1 and the subcases 2 of the tool box assembly (B) are similar to those of the main case 1 and the subcases 2 of the tool box assembly (A) except for the tenon joint (T). The tenon joint (T) on each of the outer faces 180, 201 of the tool box assembly (B) includes an elongated tenon 46, (46*a*).

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A tool box assembly comprising:

a main case including a pair of main casing halves each of which has a top end, a bottom end and two opposite side ends between said top and bottom ends, said main casing halves being hinged together at the bottom ends thereof, each of said main casing halves having a wall panel which extends between said top, bottom and side ends and which is opposite to said wall panel of the other one of said main casing halves, said wall panel having an inner part formed integrally with an inner containing portion and an outer part having an outer face and formed integrally with an outer containing portion;

two subcases respectively and removably received in the outer containing portions of the wall panels of said main casing halves, each of said subcases having a cover and a housing which is hinged to said cover and which contacts face-to-face said outer face of said outer part of a respective one of said main casing halves;

interlocking members for releasably retaining said subcases in said outer containing portions of said wall panels, said interlocking members being formed integrally on said wall panels of said main case and the housings of said subcases; and said outer containing portion of said wall panel of each of said main casing halves being opened at said top end for removal one of said subcases from said outer containing portion, and being further opened at said outer face of said outer part of said wall panel.

2. A tool box assembly as claimed in claim 1, wherein the interlocking members of said subcases are interengageable for coupling releasably said subcases after said subcases are removed from said outer containing portions, and wherein said interlocking members of said subcases are engageable respectively with the interlocking members of said wall panels to retain said subcases in said outer containing portions.

3. A tool box assembly as claimed in claim 2, wherein said outer containing portion of said wall panel of each of said main casing halves includes a surrounding wall which projects outwardly from and transversely of said outer face of said outer part of said wall panel and which extends along said bottom and side ends of said main casing halves.

4. A tool box assembly as claimed in claim 3, wherein each of said main casing halves has an imaginary axis of symmetry extending from said top end to said bottom end, said housing of each of said subcases having a top and a bottom end, an outer face extending between said top and bottom ends and opposite to said outer face of said wall panel of a respective one of said main casing halves, and an imaginary axis of symmetry extending from said top end to said bottom end of said housing, said interlocking members including a mortise joint and a tenon joint formed on said outer face of each of said wall panels and said housings respectively at two symmetrical positions about said imaginary axis of symmetry of a respective one of said main casing halves and the housings and parallel to said imaginary axis of symmetry, said tenon joint coinciding with said mortise joint.

5. A tool box assembly as claimed in claim 4, wherein said mortise joint of each of said interlocking members includes an elongated mortise which extends from said top end to said bottom end of a respective one of said main casing halves and said housings and which has an intermediate enlarged portion with a width wider than that of said tenon joint.

6. A tool box assembly as claimed in claim 5, wherein said tenon joint of each of said interlocking members includes an elongated tenon which extends from said top end to said bottom end of a respective one of said main casing halves and said housings.

7. A tool box assembly as claimed in claim 5, wherein said tenon joint of each of said interlocking members includes at least one tenon block which has a length shorter than that of said enlarged portion of said elongated mortise and which is capable of engaging said elongated mortise of another one of said interlocking members by passing through said enlarged portion.

8. A tool box assembly as claimed in claim 4, wherein said outer face of each of said wall panels and said housings has a positioning protrusion formed at one side of said imaginary axis of symmetry of a respective one of said main casing halves and said housings and spaced from one of said mortise joint and said tenon joint, and a slide groove formed at the other side of said imaginary axis of symmetry and spaced from the other one of said mortise joint and said tenon joint, said slide groove having at least one constricted portion to confine a locking area in said slide groove, said locking area coinciding with said positioning protrusion and being symmetrical to said positioning protrusion about said imaginary axis of symmetry.

9. A tool box assembly as claimed in claim 8, wherein said outer face of each of said wall panels and said housings further has at least one guiding protrusion formed adjacent to said positioning protrusion and slidable in said slide groove of the other one of said wall panels and said housings.

* * * * *